US011142726B2

(12) United States Patent
Berton et al.

(10) Patent No.: US 11,142,726 B2
(45) Date of Patent: Oct. 12, 2021

(54) ENZYME BASED PRODUCTS FOR CAR WASHES

(71) Applicant: FRA-BER S.R.L., Antegnate (IT)

(72) Inventors: Franco Berton, Antegnate (IT); Gabriele Berton, Antegnate (IT)

(73) Assignee: FRA-BER S.R.L., Antegnate (IT)

( * ) Notice: Subject to any disclaimer, the term of this patent is extended or adjusted under 35 U.S.C. 154(b) by 166 days.

(21) Appl. No.: 15/789,558

(22) Filed: Oct. 20, 2017

(65) Prior Publication Data

US 2018/0037849 A1 Feb. 8, 2018

Related U.S. Application Data

(62) Division of application No. 14/890,322, filed as application No. PCT/IB2014/000712 on May 13, 2014, now abandoned.

(30) Foreign Application Priority Data

May 13, 2013 (IT) ..... MI2013A000782

(51) Int. Cl.

| | |
|---|---|
| ***C11D 3/386*** | (2006.01) |
| ***C11D 3/38*** | (2006.01) |
| ***C11D 11/00*** | (2006.01) |

(52) U.S. Cl.

CPC ..... *C11D 3/386* (2013.01); *C11D 3/381* (2013.01); *C11D 3/38627* (2013.01); *C11D 11/0023* (2013.01); *C11D 11/0029* (2013.01)

(58) Field of Classification Search

None

See application file for complete search history.

(56) References Cited

U.S. PATENT DOCUMENTS

| | | | | |
|---|---|---|---|---|
| 5,871,590 | A * | 2/1999 | Hei | C11D 1/42 134/2 |
| 6,191,092 | B1 | 2/2001 | Braulla et al. | |
| 2002/0111287 | A1 | 8/2002 | Bauer | |
| 2003/0040458 | A1* | 2/2003 | Olson | C11D 3/06 510/446 |
| 2005/0049166 | A1 | 3/2005 | Huang | |
| 2008/0229531 | A1* | 9/2008 | Takida | B60S 3/042 15/53.2 |
| 2010/0233146 | A1* | 9/2010 | McDaniel | A01N 63/02 424/94.2 |
| 2011/0015110 | A1 | 1/2011 | Kellar | |
| 2012/0108488 | A1 | 5/2012 | Lant | |
| 2014/0274857 | A1* | 9/2014 | Schacht | C11D 1/22 510/234 |

FOREIGN PATENT DOCUMENTS

| | | | |
|---|---|---|---|
| CN | 102277245 | A | 12/2011 |
| GB | 2283982 | A | 5/1995 |
| RU | 2413756 | C2 | 3/2011 |
| RU | 2431655 | C2 | 10/2011 |
| WO | 9425561 | A1 | 11/1994 |
| WO | 9621716 | A1 | 7/1996 |
| WO | 2007106293 | A1 | 9/2007 |
| WO | 2007138054 | A1 | 12/2007 |
| WO | 2014106593 | A1 | 7/2014 |

OTHER PUBLICATIONS

Simoniz "Simoniz: Detail Direct", 6th edition, available online at the company's webpage <https://www.simoniz.com/Customer-Content/www/CMS/files/Detail-Direct-Brochure/Detail_Direct_Sixth_Edition.pdf>, copyright 2018 (Year: 2018).*

Office Action for Corresponding Russian Appl No. 2015153414, dated Oct. 26, 2017, 6 pages.

Office Action for Corresponding Russian Appl No. 2015153414, dated Apr. 5, 2018, 4 pages.

PCT International Search Report and Written Opinion dated Sep. 5, 2014, which is issued on related PCT International Application No. PCT/IB2014/000712 (10 pages).

Italian Search Report completed on Feb. 28, 2014, which is issued on related Italian Patent Application No. MI2013A000782 (2 pages).

European Office Action for Corresponding European Patent Application No. 14730984.3 (6 pages) (dated Jul. 6, 2018).

* cited by examiner

*Primary Examiner* — Emily A Cordas

(57) ABSTRACT

The present invention relates to a liquid composition soluble in water or other polar substance and its use for vehicle cleansing and care, in particular for all the treatments provided in the washing steps of vehicles.

The composition comprises at least one active enzymatic component.

15 Claims, No Drawings

ENZYME BASED PRODUCTS FOR CAR WASHES

CROSS REFERENCE TO RELATED APPLICATION

This application is a Divisional of U.S. patent application Ser. No. 14/890,322 filed Nov. 10, 2015, which in turn is a 371 of PCT/IB2014/000712 filed May 13, 2014, which claims the benefit of Italian Patent Application No. MI2013A000782 filed May 13, 2013, the contents of each of which are incorporated herein by reference.

BACKGROUND OF THE INVENTION

As known, in the vehicle cleaning and care field, in particular of cars, lorries and lorries with trailer, as well as public and private buses, different products are used, able to clean vehicles and impart brilliance and brightness to their surface.

In fact, a cleaned vehicle of polished and brilliant appearance is not only more pleasing to the eye, but also offers guarantee of improved hygiene thanks to its cleaning. Beyond the personal care that is reserved to our own vehicle, there are common use systems for vehicle cleaning and care, providing for a series of standardized procedures and steps.

For example, such systems are represented by manual, automatized or semi-automatized car washes for motorbikes, cars or industrial vehicles of bigger sizes such as lorries, lorries with trailer and buses.

Car cleaning is, in fact, a common problem.

Cars, and in general motor vehicles intended for both private use and industrial motor vehicles, get dirty quite fast, especially in winter and due to frequent rains, it is difficult to keep them cleaned if they are not washed at least once a week or about every 10 days.

Just for this reason, in towns and in general in inhabited areas, a number of car washes with service and/or self-service, multiplied.

In car washes with service, the washing mode for the vehicle in general and subsequently the washing mode for both internal and external parts can be selected. Automatic washing (with brushes, or tunnel) allows cleaning and cleansing of the vehicle body as well as some other parts such as, for example, rims, rear-view mirrors. Normally, the cleansing step is carried out automatically by passing the vehicle between at least two rotating brushes that are soaked in the detergent substance and that, rotating at high speed on the car body and at the same time going across the whole vehicle length, contribute to its cleaning. Once the real and proper cleansing step has finished, the vehicle is rinsed by water jets e then subjected to a step with brightener substances and waxes that, once dried under a hot air jet, contribute to make the vehicle particularly polished and brilliant.

For example, in the particular case of cars, a self-service car wash can be defined as a place suitably equipped for vehicle cleaning and washing. The structure of the station, is in general constituted by modular areas: box for washing the car body, area for internal cleaning of cars and mats and, finally, empty space available for the car driver for all the operations of internal cleaning and/or manual drying of the car body. Each box is equipped with spray nozzle, with which all the washing and rinsing steps are performed, brush and coin acceptor with programming unit allowing to select between different washings, preferably to be sequentially performed (pre-washing with warm water and detergent—washing with hot water and detergent—brush washing—rinsing with cold water, also de-mineralized—final step with brilliant and self-drying liquid). A problem is often represented by the fact that the use of detergents involves the formation of a number of pollutants to the environment and difficult to dispose of. Furthermore, the accumulation of waste water coming from different steps of the vehicle cleaning provided in car washes and described above, involves the formation of bad smells, the formation of algae or molds or different microorganisms that can lead to station damages. In particular, in the case of car washes equipped with brushes, algae and/or molds can easily accumulate on the brushes which are always a bit wet between one use and the subsequent, and generally they can be found necessarily in a particularly wet environment and favorable to the growth of unwanted organisms. A further problem is represented by the needs of applying concentrations of detergent agent which are considerably higher than necessary, with the purpose of obtaining a vehicle cleaning that is evident also from the aesthetic point of view.

SUMMARY OF THE INVENTION

Thus an object of the present invention is to provide a composition for vehicle cleansing and care, allowing to reduce the amount of detergent used, still maintaining the same or increased cleaning efficacy.

Another object of the present invention is to provide a composition for vehicle cleansing and care allowing to reduce or avoid the use of highly pollutant auxiliary to vehicle cleansing.

Also an object of the present invention is to provide a composition for vehicle cleansing and care allowing to reduce/eliminate bad smells from the vehicle cleaning station wherein said composition is used as well as from accumulation tanks of waste water.

Still an object of the present invention is to provide a composition for vehicle cleansing and care allowing to reduce or completely avoid the formation of algae/mold on walls and/or brushes of the car wash.

These and other objects and related advantages that will be better highlighted by the following description, are achieved by a composition for vehicle cleansing and/or care comprising at least one enzymatic component and/or a microorganism.

DETAILED DESCRIPTION OF THE INVENTION

According to the invention, said enzymatic component is present in a percentage between 1% and 10% by weight based on the total weight of the composition, preferably about 5%.

According to the present invention, with the term "enzymatic component" is meant a biological catalyst of protein type able to catalyze chemical reactions. Enzymatic reactions are characterized by specific reaction conditions, high reaction rates, generally high yields and by the fact that each single enzyme is specific to a particular reaction type. Therefore enzymes are able to cleave naturally the substances causing the dirt, then easing the removal during washing. There are different types of enzymes applied in cleaning products. For example lipase enzymes, that cleave molecules of oils and fats, whereas amylase enzymes attack and break up starches, making easier the removal of stains from fabrics by products wherein starch is one of the major components, are known.

Some enzyme types advantageously used according to the present invention are, for example, those currently available in the market with the name of STAINZYME® 12 L (containing an α-amylase), SAVINASE® 16 L (containing a protease), Linea freshen, GREASE GUARD™ D Lipase (containing bacterial cultures with a lipase). In particular, STAINZYME® 12 L and SAVINASE® L are advantageously used in a detergent composition according to the present finding, whereas Linea freshen and GREASE GUARD™ D Lipase are advantageously used, still according to the invention, in the final waxing treatment of the vehicle.

Enzymes are formed naturally and are a renewable energy resource. Adding the enzymes to the detergent products allows reducing the environmental impact of chemical products based on petroleum, such as surfactants and builders, with a corresponding saving of raw materials in the product formulation, and reduction of wastes, thanks to a better compaction.

Enzymes are also completely biodegradable and are non-toxic for plants and animals. Once their action has been accomplished, they are washed away with waste water, within which they are naturally broken up and recycled by the organisms.

Enzymes further operate at a temperature of only 20° C., which products with surfactants only are not able to do. All of this becomes a significant "energy saving". The composition according to the invention provided for the use of enzymes and/or microorganisms beneficial in car and motor vehicle detergents in general, in particular in car washes, used in the whole cycle of automatic washing or in self tracks or manual washing. The main advantages are identifiable, for example, in the possibility to decrease the use of pollutant auxiliary to classical detergents, possibility to increase the cleaning power of the composition, as well as to decrease bad smells that can easily be formed both in the station and waste-water accumulation tanks, before sending them to the treatment plant.

Furthermore, the composition according to the invention allows to avoid the formation of algae, molds or others on the walls of car washes as well as on the brushes of the stations themselves. A further advantage of the composition according to the invention is represented by being able to increase the washing rate e therefore to decrease the washing times themselves.

A further advantage is represented by the fact that the user/manager of the car wash can purchase the classic cleansing products but don't need to use other products to clean the station, the accumulation tanks of the treatment plant and the brushes.

The above mentioned advantages are achieved by the composition according to the invention, that provides for being able to use the enzymatic component and/or microorganism within all the products used in car washes, in order to have what can be defined as a "cyclic system", where each product used in the station has its own function. This "cyclic system" can be made, for example, by the use of different enzymes and/or microorganisms depending upon the position in the car wash. In other words, a composition according to the invention intended for the cleansing cycle, will involve the simultaneous presence of at least one detergent and at least one enzymatic component, whereas the composition, still according to the invention, intended for the finishing and polishing of the vehicle, will involve the simultaneous presence of at least one wax or polishing agent and at least one enzymatic component, that could be different o equal to the previous one. In other words, each step provided in the car wash will be characterized by its product that will consist, according to the present invention, on a composition comprising at least one enzymatic component/microorganism variable in its nature depending upon the use for which the composition is intended for.

Preferably, the compositions according to the present invention are liquid.

In other words, if the typical cycle of a car wash is considered, the use of the composition according to the present invention allows not only to increase the detergent/polishing power of the used different products, still maintaining the advantages described above in detail, but also obtaining a degree of cleaning that is difficult to achieve with traditional products, for example in car washes lacking in the aid of brushes. This aspect becomes possible just by the presence of enzymes or microorganisms in the detergent composition according to the invention, allowing to achieve a deep level of cleansing still reducing the use of the detergent product and/or in the absence of brushes auxiliary to vehicle cleaning.

Still according to the present invention, the enzymes can be partially or completely substituted by different microorganisms, for example some bacteria types, that are able to exert similar adjuvant action, the cleansing and in general to eliminate bad smells from waste-water accumulation tanks of car washes.

From the final user point of view, the products according to the present invention are provided for example in cans, containing detergents or shampoo or waxes, each supplemented with enzymes and/or microorganisms with different functions. The product put in the automatic station of the car wash for vehicles, is diluted with small pumps and is poured on the car carrying out its detergent or shampooing function, by use of brushes or wax. Subsequently, it comes into the accumulation tanks of waste water to be subjected to the actions of the treatment plant. During these steps, the functions of the products can be multiple as described above.

Products and compositions according to the present invention, can also be used in manual mode and therefore simply diluted with water and poured manually on the car, obtaining the same beneficial effects.

Therefore the composition according to the present invention represents an innovative solution to the cleansing of motor vehicles and vehicles in general and in particular cars.

Therefore it is a car detergent composition based on enzymes, representing an eco-sustainable and effective product for cleaning, thanks to the presence of innovative enzymatic and microbial solutions, able to satisfy each hygiene and brilliance need. One of the main advantages of the composition according to the present invention, is to be able to accommodate high cleaning performances with a reduced use of time and efforts by final users, still keeping in mind the protection of the environment. Thereby the composition of the invention allows obtaining high quality cleaning and very low environmental impact, thanks to the substitution of ingredients based on non-renewable sources (such as petroleum) with natural elements and with high rinsability factor, assuring water conservation and low greenhouse gas emission.

Therefore the composition object of the invention represents a full range of eco-efficient solutions for cleansing of cars and more in general of motor vehicles with superior quality, together with products for cars polishing and protection.

The composition object of the invention is the first example of composition comprising enzymes and microorganisms beneficial to cleaning of vehicles, in particular cars, more and more in-depth, washing after washing.

Therefore, according to the invention, it is possible to carry out the removal of the toughest dirt from vehicles in general and particularly cars, as well as the simultaneous elimination of organic substances and the restraint of bad smells in the treatment plant systems of the car washes themselves.

Moreover, the compositions according to the invention are readily biodegradable and environmentally friendly, thereby reducing their environmental impact.

Different dirt residues, such as oil, fat and stains, hide in microscopic cavities and cracks of hard surfaces, thereby becoming difficult to be completely removed.

With the composition according to the invention, the active enzymatic components penetrate deeply in surfaces pores and immediately degrade a wide range of organic residues not visible to the naked eye, really improving the quality of cleaning. Therefore some advantages can be summarized as follows:

In-depth and immediate cleaning of motor vehicles, in particular cars, and other exterior surfaces;

cleaning lasts longer, thanks to the removal of organic residues continuing even after the application;

radical control of smells, thanks to complete biodegradation of the molecules of dirt also within the treatment plant systems, on the brush surfaces and, in general, on the walls of car washes.

Guarantee of deep and immediate cleaning

Elimination of smelling molecules in the accumulation tanks

Protective cleaning action on vehicles, in particular on cars, and on any other surfaces Rapid biodegradability Product derived from renewable energy Gentle on fabrics Reduction of the use of water-polluting chemical substances and petroleum derivatives Reduction of the negative impact of detersives on the environment.

With reference to what above described, by way of example only and non-limiting, an example of composition according to the invention for use in car washes is provided.

EXAMPLE 1

Indicative Composition of the Detergent Composition

Formulation Example 1

Surfactant % (w/w)
LAS 4%
Soap 12%
Ethoxylated Alcohol 12%
Builders
Na2CO3 2%
NaCl 3%
Na-citrate 5%
Phosphonate 1%
Hydrotrope
SCS 0.5%
Solvents
MPG 7%
Ethanol 5%
Water 43.50
Enzymes
Enzymes 5% (pH 8-9)

The invention claimed is:

1. A method for washing a vehicle, said method comprising:

providing a composition including an enzymatic component, wherein said enzymatic component comprises bacteria; wherein composition consists of (w/w):

linear alkylbenzene sulfunates (LAS) 4%;
soap 12%;
ethoxylated alcohol 12%;
$Na_2CQ_3$ 2%;
NaCl 3%;
Na-citrate 5%;
phosphonate 1%;
sodium cumene sulfonate (SCS) 0.5%;
water; and
enzymes between 1-10%, at pH 8-9; and
washing said vehicle with said composition.

2. The method as in claim 1, wherein said washing comprises diluting said composition with water by pumping said water in an automated car wash station and introducing said diluted composition to contact said vehicle in said automated car wash station.

3. The method as in claim 1, further comprising after said washing, introducing a further composition being a liquid and including a second enzymatic component, to contact said vehicle along with wax, said first enzymatic component differing from said second enzymatic component.

4. The method as in claim 1, wherein said enzymatic component is present in a concentration of 5% by weight.

5. The method as in claim 1, wherein said enzymatic component further comprises an amylase.

6. The method as in claim 1, wherein said enzymatic component further comprises a protease.

7. The method as in claim 1, wherein said enzymatic component comprises a lipase.

8. The method as in claim 1, wherein said vehicle is an automobile, said enzymatic component is a microorganism.

9. A method for washing a vehicle in an automated car wash, said method comprising providing a composition consisting of an enzymatic component, surfactants, water, hydrotropes and builders, wherein said enzymatic component is a bacteria; wherein composition consists of (w/w)

LAS 4%;
soap 12%;
ethoxylated alcohol 12%;
$Na_2CQ_3$ 2%;
NaCl 3%;
Na-citrate 5%;
phosphonate 1%;
SCS 0.5%;
water; and
enzymes at pH 8-9 delivering said composition to a vehicle in said automated car wash; and washing said vehicle with said composition.

10. The method as in claim 9, wherein said delivering comprises diluting said composition with water and delivering said diluted composition to contact said vehicle, wherein said washing includes brushing using rotating brushes soaked with said diluted composition.

11. The method as in claim 9, wherein the delivering comprises delivering said composition with a spray nozzle.

12. The method as in claim 11, further comprising, after said washing, further delivering a further composition being a liquid and including a second enzymatic component to said vehicle along with wax, said first enzymatic component differing from said second enzymatic component.

13. The method as in claim 11, wherein said enzymatic component is present in a concentration of 5% by weight.

14. The method as in claim 9, wherein said composition is liquid and said delivering includes delivering said composition along with wax, to said vehicle.

15. The method as in claim 9, wherein said enzymatic component comprises an amylase, a protease or a lipase.

* * * * *